US010681464B2

(12) United States Patent
Kim et al.

(10) Patent No.: US 10,681,464 B2
(45) Date of Patent: Jun. 9, 2020

(54) ACOUSTIC DIAPHRAGM INCLUDING GRAPHENE AND ACOUSTIC DEVICE EMPLOYING THE SAME

(71) Applicant: Samsung Electronics Co., Ltd., Suwon-si, Gyeonggi-do (KR)

(72) Inventors: Sangwon Kim, Seoul (KR); Hyeonjin Shin, Suwon-si (KR); Minsu Seol, Seoul (KR); Dongwook Lee, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/173,516

(22) Filed: Oct. 29, 2018

(65) Prior Publication Data

US 2020/0015016 A1 Jan. 9, 2020

(30) Foreign Application Priority Data

Jul. 3, 2018 (KR) ..... 10-2018-0077315

(51) Int. Cl.
*H04R 7/06* (2006.01)
*H04R 15/00* (2006.01)
(Continued)

(52) U.S. Cl.
CPC ..... *H04R 7/122* (2013.01); *H04R 7/06* (2013.01); *H04R 7/127* (2013.01); *H04R 15/00* (2013.01);
(Continued)

(58) Field of Classification Search
CPC ..... H04R 7/122; H04R 7/06; H04R 7/127; H04R 15/00; H04R 17/00; H04R 19/00;
(Continued)

(56) References Cited

U.S. PATENT DOCUMENTS 7,101,612 B2 9/2006 Lang et al.
9,173,033 B1 10/2015 Lin et al.
(Continued)

FOREIGN PATENT DOCUMENTS

CN 107493557 A 12/2017
GB 2530787 A 4/2016

OTHER PUBLICATIONS

Cheng Li, Analyzing the applicability of miniature ultra-high sensitivity Fabry—Perot acoustic sensor using a nanothick graphene diaphragm, Jul. 10, 2015, Measurement Science and Technology.*
(Continued)

*Primary Examiner* — Vivian C Chin
*Assistant Examiner* — Friedrich Fahnert
(74) *Attorney, Agent, or Firm* — Harness, Dickey & Pierce, P.L.C.

(57) ABSTRACT

Provided are an acoustic diaphragm and an acoustic device including the same. The acoustic diaphragm may include graphene nanoparticles, and an average particle size of the graphene nanoparticles may be about 10 nm or less. The graphene nanoparticles substantially may have a particle size of about 1 nm to about 10 nm. The graphene nanoparticles may include at least one functional group selected from a hydroxyl group, a carboxyl group, a carbonyl group, an epoxy group, an amine group, and an amide group.

19 Claims, 13 Drawing Sheets

(51) Int. Cl.
*H04R 17/00* (2006.01)
*H04R 19/00* (2006.01)
*H04R 7/12* (2006.01)

(52) U.S. Cl.
CPC ..... *H04R 17/00* (2013.01); *H04R 19/00* (2013.01); *H04R 2307/021* (2013.01); *H04R 2307/023* (2013.01); *H04R 2307/025* (2013.01); *H04R 2307/027* (2013.01)

(58) Field of Classification Search
CPC ..... H04R 2307/021; H04R 2307/023; H04R 2307/025; H04R 2307/027
USPC ..... 381/87, 111, 164, 335, 337, 426
See application file for complete search history.

(56) References Cited

U.S. PATENT DOCUMENTS

2006/0057050 A1* 3/2006 Ren ..... B82Y 30/00 423/291
2006/0121279 A1* 6/2006 Petrik ..... B82Y 30/00 428/403
2009/0074228 A1 3/2009 Mango, III et al.
2011/0026750 A1* 2/2011 Wang ..... B82Y 30/00 381/335
2016/0157022 A1 6/2016 Zhou et al.
2016/0173967 A1* 6/2016 Nawrocki ..... H04R 1/04 381/111
2016/0291472 A1* 10/2016 Shin ..... G03F 7/094
2017/0006382 A1 1/2017 Luzzato et al.
2017/0155993 A1 6/2017 Boesen
2017/0221996 A1* 8/2017 Park ..... H01L 29/1606
2017/0251318 A1 8/2017 Gaskell et al.
2017/0327379 A1* 11/2017 Ghimire ..... C01B 32/184
2018/0179397 A1* 6/2018 Kim ..... C09D 7/62

OTHER PUBLICATIONS

Tsoukleri et. al., Subjecting a Graphene Monolayer to Tension and Compression, 2009, Wiley-VCH Verlag GmbH & Co. KGaA, Weinheim, p. 2397.*
N.Gobi et al. "Infusion of Graphene Quantum Dots to Create Stronger, Tougher, and Brighter Polymer Composites" ACS Omega, 2017, 2 (8), pp. 4356.
Zhou,Q., et al. "Electrostatic Graphene Loudspeaker" A.Zettl, APL 102 (2013) 223109.
Coleman, J.N. et al. "Small but strong: A review of the mechanical properties of carbon nanotube-ploymer composities" Carbon, 44 (2006), pp. 1624.
Cox, H.L., et al. "The elasticity and strength of paper and other fibrous materials" HL Cox 1952 Br.J.App. Phys. 3 72.
Kelly, A. et al., "Tensile Properties of Fibre-Reinforced Metal: Copper/Tungsten and Copper/Molybdenum" J Mech Phys Solids, 13 (6) (1965), pp. 329.
Coleman, J.N. et al. "High-Performance Nanotube-Reinforced Plastics: Understanding the Mechanism of Strength Increase" Adv Funct Mater, 14 (2004), pp. 791.
Carmen, G.P. et al. "Micromechanics of short-fiber composites" Compos Sci Technol, 43 (1992), pp. 137.
www.explainthatstuff.com (last retrieved Oct. 5, 2018).
https://giphy.com/gifs/speakers-pgyXuj2kcgv7i (last retrieved Oct. 8, 2018).

* cited by examiner

ACOUSTIC DIAPHRAGM INCLUDING GRAPHENE AND ACOUSTIC DEVICE EMPLOYING THE SAME

CROSS-REFERENCE TO RELATED APPLICATION

This application claims the benefit of Korean Patent Application No. 10-2018-0077315, filed on Jul. 3, 2018, in the Korean Intellectual Property Office, the disclosure of which is incorporated herein in its entirety by reference.

BACKGROUND

1. Field

The present disclosure relates to an acoustic diaphragm and an acoustic device including the same.

2. Description of the Related Art

Acoustic devices such as speakers, receivers, microphones, and earphones are used in various electronic apparatuses such as acoustic apparatuses, image/display devices, laptop computers, tablet PCs, and mobile phones. An acoustic diaphragm, which is also called an acoustic vibration diaphragm, is an important component in acoustic devices. The diaphragm of a speaker needs to be capable of sufficiently producing a clear sound in a wide frequency band, in particular, in a high-frequency range.

As of now, cellulose, a polymer-based material such as polyester, or a metal-based material such as aluminum (Al), is used in most commercially available acoustic diaphragms. However, with the miniaturization of electronic apparatuses, it is becoming difficult to realize good sound quality by using a small-sized diaphragm. In the case of large-sized audio devices as well as small-sized devices, rare metals or carbon-based materials are used to achieve good sound quality. However, manufacturing processes using these materials are not easy to perform and even result in environmental problems.

In the development of materials for an acoustic diaphragm, to improve sound quality and durability, it is necessary to consider various aspects such as uniformity, processability improvements, stability, and environmental issues, as well as various mechanical properties.

SUMMARY

Provided are acoustic diaphragms having excellent characteristics in aspects of mechanical properties, processability, durability, uniformity, and environmental stability, and acoustic devices employing the acoustic diaphragms.

Provided are acoustic diaphragms that stably provide good sound quality even in a high-frequency region, and acoustic devices using the acoustic diaphragms.

Provided are electronic apparatuses including the above acoustic device.

Additional aspects will be set forth in part in the description which follows and, in part, will be apparent from the description, or may be learned by practice of the presented embodiments.

According to an aspect of an embodiment, an acoustic diaphragm for an acoustic device includes a graphene-containing layer including graphene nanoparticles, wherein an average particle size of the graphene nanoparticles is in a range of 10 nm or less.

In some embodiments, the graphene nanoparticles may substantially have a particle size of about 1 nm to about 10 nm.

In some embodiments, the graphene nanoparticles may include at least one functional group selected from a hydroxyl group, a carboxyl group, a carbonyl group, an epoxy group, an amine group, and an amide group.

In some embodiments, the graphene nanoparticles may have a carbon content in a range of about 50 at % to about 95 at %.

In some embodiments, the graphene-containing layer may further include at least one different material other than graphene.

In some embodiments, the at least one different material may include at least one selected from a polymer, a single molecule, a metal, and a metal complex.

In some embodiments, the at least one different material may include one selected from an organic material, an inorganic material, and an organic-inorganic composite material.

In some embodiments, an amount of the graphene nanoparticles in the graphene-containing layer may be in a range of about 1 wt % to about 99 wt %.

In some embodiments, an amount of the graphene nanoparticles in the graphene-containing layer may be in a range of about 30 wt % to about 90 wt %.

In some embodiments, the acoustic diaphragm may further include an auxiliary layer, wherein the graphene-containing layer may be arranged on one surface or two opposite surfaces of the auxiliary layer.

In some embodiments, the auxiliary layer may include at least one selected from cellulose, a polymer-based material, a metal-based material, and a carbon-based material.

In some embodiments, the auxiliary layer may include at least one selected from paper, polyester, aluminum (Al), titanium (Ti), beryllium (Be), carbon fiber, and CVD synthetic diamond.

In some embodiments, the acoustic diaphragm may further include a first auxiliary layer and a second auxiliary layer, and the graphene-containing layer may be arranged between the first auxiliary layer and the second auxiliary layer.

In some embodiments, the acoustic diaphragm may have a cone shape, a flat plate shape, or a dome shape.

According to another aspect of the present disclosure, an acoustic device includes: the acoustic diaphragm; a support configured to support the acoustic diaphragm; and an electro-acoustic transducer connected to the acoustic diaphragm.

In some embodiments, the electro-acoustic transducer may be configured to convert an electrical signal into an acoustic signal.

In some embodiments, the electro-acoustic transducer may be configured to convert an acoustic signal into an electrical signal.

In some embodiments, the acoustic device may be an electromagnetic-type device, an electrostatic-type device, or a piezoelectric-type device.

In some embodiments, the acoustic device may be any one of a speaker, an earphone, a headphone, and a microphone.

According to an aspect of another embodiment, an electronic apparatus includes the acoustic device described above.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
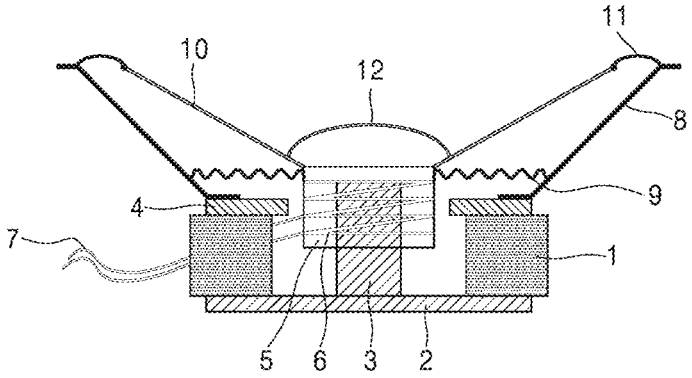
FIG. 1 shows a cross-sectional view of an acoustic device including an acoustic diaphragm, according to an embodiment.

Various example embodiments will now be described more fully with reference to the accompanying drawings in which example embodiments are shown.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, an acoustic diaphragm, an acoustic device including the acoustic diaphragm, an acoustic diaphragm, and an electronic apparatus using an acoustic device, according to embodiments, will be described in detail with reference to the accompanying drawings. The width and thickness of the layers or regions illustrated in the accompanying drawings may be somewhat exaggerated for clarity and ease of description. Like reference numerals refer to like elements throughout the specification.

FIG. 1 shows a cross-sectional view of an acoustic device including an acoustic diaphragm 10 according to an embodiment. The acoustic device according to the present embodiment is a speaker device.

Referring to FIG. 1, a magnet 1, which is a ring-shaped permanent magnet, may be provided. The magnet 1 may include ferrite, neodymium or the like, but a material for forming the magnet 1 is not limited thereto. A lower plate 2 may be provided below the magnet 1 and a pole piece 3 may be provided at the center of the lower plate 2. The pole piece 3 may be a center pole or a columnar protrusion. An upper plate 4 may be provided on the magnet 1. The upper plate 4 may have a shape having an opening area at the center, for example, a ring shape, but is not limited thereto.

A voice coil bobbin 5 may be provided to surround the pole piece 3 and a voice coil 6 may be formed on the voice coil bobbin 5. A wiring portion 7 extending from the voice coil 6 may be provided. Although not shown, the wiring portion 7 may be connected to an amplifier.

A supporting frame 8 may be fixedly mounted on the upper plate 4. The supporting frame 8 may have a funnel shape or any shape being similar to the funnel shape. The supporting frame 8 may be a kind of basket.

The acoustic diaphragm 10 may be provided in a concave region of the supporting frame 8. The acoustic diaphragm 10 will now be referred to as the diagram 10. The diaphragm 10 may have a cone shape. The diaphragm 10 may have one end (lower end) connected to the voice coil bobbin 5 and another end (upper end) connected to the supporting frame 8. A surround member 11 may be provided between the other end (upper end) of the diaphragm 10 and the supporting frame 8. The surround member 11 may include an elastic rubber, a foam rubber, a textile, or the like, and may flexibly connect the diaphragm 10 to the supporting frame 8.

A damper member 9 may be provided between the supporting frame 8 and the voice coil bobbin 5. The damper member 9 may allow the voice coil bobbin 5 and the voice coil 6 to move while holding the voice coil bobbin 5 and the voice coil 6. The damper member 9 may have a corrugated structure and may be flexible. The damper member 9 may be a kind of suspension and may be called a spider.

A dust cover 12 may be provided above the voice coil bobbin 5. The dust cover 12 may have a dome shape and may be provided to cover a portion of a central portion of the diaphragm 10. The dust cover 12 may be a dust cover, that is, a dust cap.

Depending on an electrical signal applied to the voice coil 6, the voice coil bobbin 5 may move up and down around the pole piece 3 due to an electromagnetic force, thereby leading to the vibration of the diaphragm 10. A sound corresponding to the vibration of the diaphragm 10 may occur. The pole piece 3 may enhance the magnetic field generated by the voice coil 6 and may control the flow of the magnetic field. The mechanical properties of diaphragm 10 in the acoustic device may be a factor in determining sound quality and durability.

In this embodiment, the diaphragm 10 may be a graphene-containing layer including graphene nanoparticles or may include the graphene-containing layer, wherein the graphene nanoparticles may have an average particle size of about 10 nm or less. A particle size of the graphene nanoparticles may substantially be from about 1 nm to about 10 nm. About 90% or more or about 95% or more of the graphene nanoparticles may have a particle size of about 1 nm to about 10 nm. Most of the graphene nanoparticles may have a particle size of, for example, about 3 nm to about 10 nm or about 5 nm to about 10 nm.

When the diaphragm 10 is formed by using graphene nanoparticles, most of which have a particle size of about 10 nm or less, the mechanical properties of diaphragm 10 may be substantially improved. In one or more embodiments, due to a functional group added to graphene nanoparticles, processability may be improved and the film uniformity of the diaphragm 10 may be improved. In addition, due to a high carbon content and a high intermolecular bonding strength of graphene nanoparticles, a diaphragm formed by using such graphene nanoparticles may have excellent durability, chemical resistance, hygroscopic resistance, and environmental stability.

Figure 2:
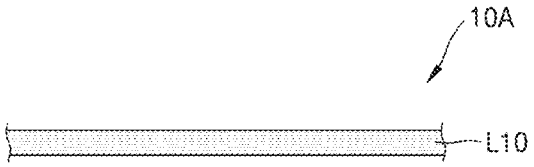
FIG. 2 shows a cross-sectional view of an acoustic diaphragm according to an embodiment.

FIG. 2 shows a cross-sectional view of a diaphragm 10A according to an embodiment.

Referring to FIG. 2, the diaphragm 10A may include a graphene-containing layer L10 containing graphene nanoparticles. The graphene-containing layer L10 is a free-standing layer, and may be used as the diaphragm 10A. The average particle size of the graphene nanoparticles may be about 10 nm or less. Most of the graphene nanoparticles may have a particle size of about 1 nm to about 10 nm.

Figure 3:
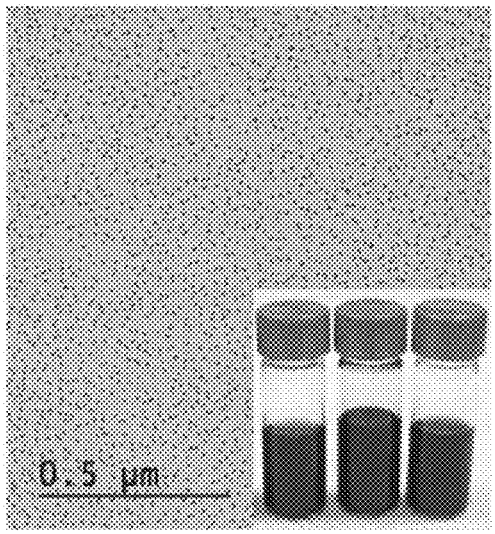
FIG. 3 shows an image of graphene nanoparticles capable of being used to manufacture an acoustic diaphragm.

FIG. 3 shows an image of graphene nanoparticles capable of being used to manufacture an acoustic diaphragm. Black dots shown in FIG. 3 are graphene nanoparticles. Graphene nanoparticles may be called graphene quantum dots (GOD). The lower right-side picture in FIG. 3 shows the graphene nanoparticles dissolved in a solvent in a vessel.

Figure 4:
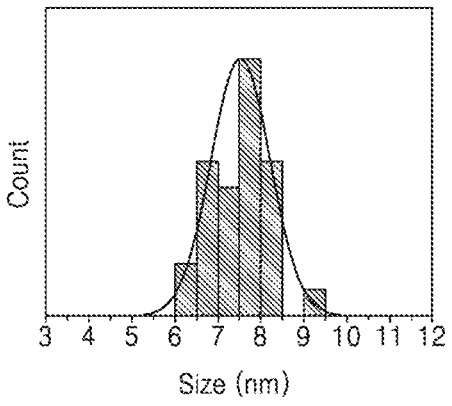
FIG. 4 shows a graph showing the results obtained by measuring the particle size distribution of graphene nanoparticles capable of being used to manufacture an acoustic diaphragm.

FIG. 4 shows a graph showing the results obtained by measuring the particle size distribution of graphene nanoparticles capable of being used to manufacture an acoustic diaphragm. Referring to FIG. 4, it can be seen that the graphene nanoparticles substantially have a size of about 10 nm or less. In the present embodiment, the graphene nanoparticles may have a size of about 5 nm to about 10 nm.

Graphene nanoparticles may have a round shape or may have various other shapes. The graphene nanoparticles may have a two-dimensional structure, that is, a planar structure, and in some cases, a plurality of graphene particles may be overlapped (laminated) to form one nanoparticle. In this case, the graphene nanoparticles may have a spherical particle shape, an oval particle shape, or any shape similar to these shapes.

In one or more embodiments, the graphene nanoparticles may include at least one functional group selected from a hydroxyl group, a carboxyl group, a carbonyl group, an epoxy group, an amine group, and an amide group. That is, graphene nanoparticles may have a 'two-dimensional carbon structure' having an aromatic ring structure, and may further include functional groups bonded thereto. The hydroxyl group may include OH, the carboxyl group may include COOH, the carbonyl group may include C═O, and the epoxy group may include oxygen (O) atoms bonded to two adjacent sp3 carbons.

Since graphene nanoparticles may have various functional groups and their particle size are as small as about 10 nm or less, the interaction energy between particles and between a particle and a matrix may be controlled.

In one or more embodiments, graphene nanoparticles may have a significantly high carbon content compared to graphene flakes having a micro or sub-micro size. For example, graphene nanoparticles may have a carbon content of about 50 at % to about 95 at % or about 80 at % to about 95 at %, and may be highly likely to inter-particle cross-link. In this regard, a diaphragm formed by using graphene nanoparticles may have excellent properties in aspects of chemical resistance, hygroscopic resistance and heat resistance.

In one or more embodiments, due to the excellent solubility in solvents caused by the small size of 10 nm or less, graphene nanoparticles may have excellent properties in aspects of solvent dispersion, uniform thin film formation, and processability, compared with graphene flakes. Accordingly, graphene nanoparticles may be suitable for a composite process.

Diaphragm formed by using graphene nanoparticles may have excellent mechanical properties. Accordingly, graphene nanoparticles may stably produce good sound quality at high frequencies (for example, 10 kHz or more) and may have excellent durability. A high sound tone-reproducing speaker, for example, a tweeter may use a high-frequency driver (2 kHz to 20 kHz), and requires a diaphragm having low mass, high stiffness, and excellent damping characteristics. Diaphragms according to embodiments may satisfy these requirements. In addition, diaphragms according to embodiments may have an excellent thin-film uniformity and may be suitable for production of a uniform sound quality. Also, diaphragms according to embodiments may be easily applied to a large-area acoustic device (for example, a speaker).

Graphene flakes have low solubility, difficulty in processing, and a low carbon content, and a thin film formed by using graphene flakes may have poor mechanical properties, low durability, and low uniformity. Compared with such graphene flakes, graphene nanoparticles according to the present embodiment may allow a diaphragm having excellent performance to be easily manufactured.

In addition, graphene nanoparticles (also called as GOD) may show excellent mechanical strength and high modulus of elasticity when forming thin films, compared to graphene oxide (GO) or carbon nanotubes (CNT).

The graphene-containing layer L10 of FIG. 2 may contain at least one different material other than graphene (graphene nanoparticles). In this regard, the at least one different material may include at least one selected from a polymer, a single molecule (monomer), a metal, and a metal complex. The at least one different material may include an organic material, an inorganic material, or an organic-inorganic composite material. The amount of graphene nanoparticles in the graphene-containing layer L10 may be in the range from about 1 wt % to about 99 wt %. In one embodiment, the amount of graphene nanoparticles in the graphene-containing layer L10 may be in the range from about 30 wt % to about 99 wt %. By appropriately mixing graphene nanoparticles and the different material to form the graphene-containing layer L10, the mechanical properties and durability of the graphene-containing layer L10 may be controlled. When a different material is used, the different material may act as a binder or a matrix. Even when the different material is not used or the different material is used, graphene nanoparticles may be bonded together, and a functional group thereof may act as a binder.

After graphene nanoparticles are dissolved in a polar solvent to form a graphene nanoparticles solution, the graphene-containing layer L10 may be formed by using a solution process. The graphene nanoparticles solution is coated on a substrate to form a thin film, and then, a drying and/or heat treatment (heat treatment at the temperature of about 700° C. or less) is performed on the thin film, thereby forming the graphene-containing layer L10. The polar solvent may include water ($H_2O$) or an organic solvent. The organic solvent may include, for example, at least one selected from N-methylpyrrolidone (NMP), dimethylformamide (DMF), tetrahydrofuran (THF), and propylene glycol methyl ether acetate (PGMEA), but is not limited thereto. In one or more embodiments, various other organic solvents may be used. At the time of forming the graphene nanoparticles solution, one or more different materials may be further used, and in this case, the graphene-containing layer L10 may include graphene nanoparticles and at least one different material.

Figure 5:
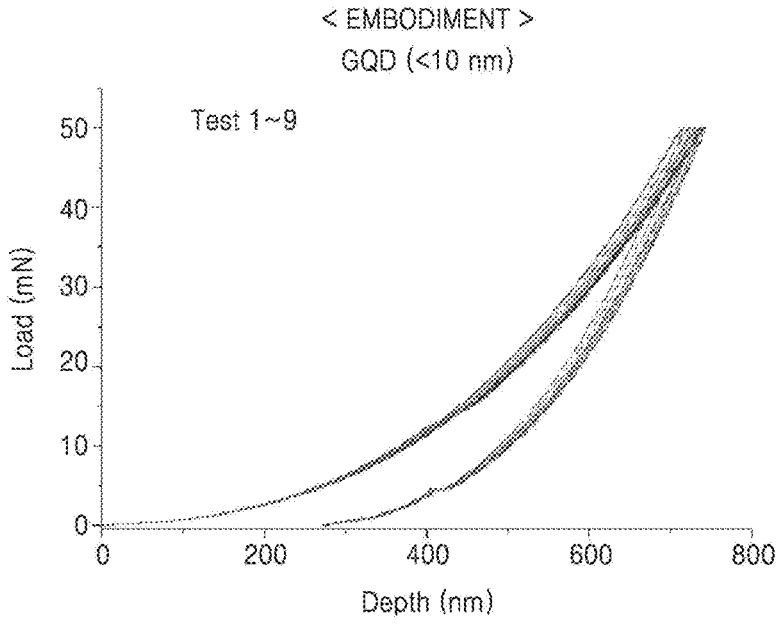
FIG. 5 shows a graph showing the results of nanoindentation tests performed on a thin film formed according to an embodiment.

FIG. 5 shows a graph showing the results of nanoindentation tests performed on a thin film formed according to an embodiment. The thin film according to the embodiment is formed by using graphene nanoparticles (also called GOD) having a particle size of about 10 nm or less.

Figure 6:
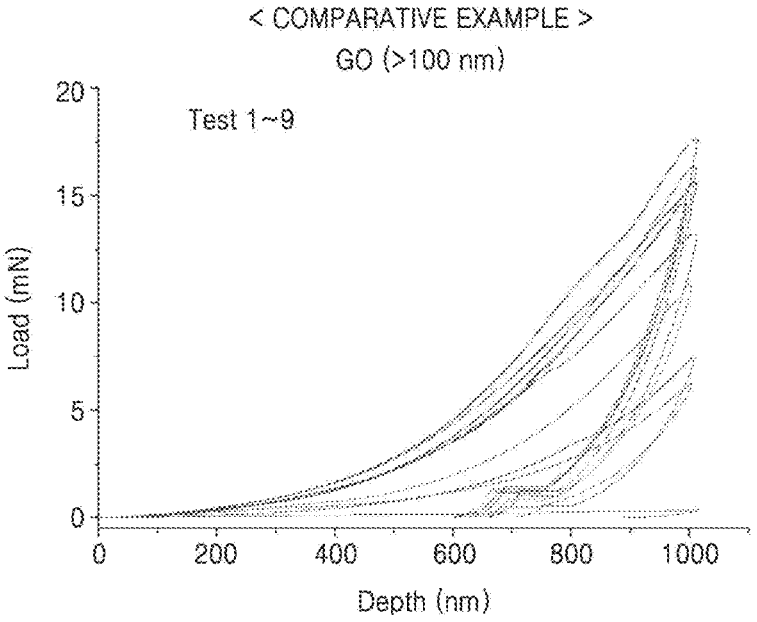
FIG. 6 shows a graph showing the results of nanoindentation tests performed on a thin film formed according to a comparative example.

FIG. 6 shows a graph showing the results of nanoindentation tests performed on a thin film formed according to a comparative example. The thin film according to the comparative example is formed by using graphene oxide (GO) particles having a particle size of 100 nm or more.

Comparing FIG. 5 with FIG. 6, although the test strength applied to the thin film of FIG. 5 is greater than the test strength applied to the thin film of FIG. 6, the thin film of FIG. 5 exhibited better recovery characteristics than the thin film of FIG. 6. In addition, in the case of the thin film of FIG. 5, even when the number of tests was increased, the change in the characteristics of the thin film was small.

Figure 7:
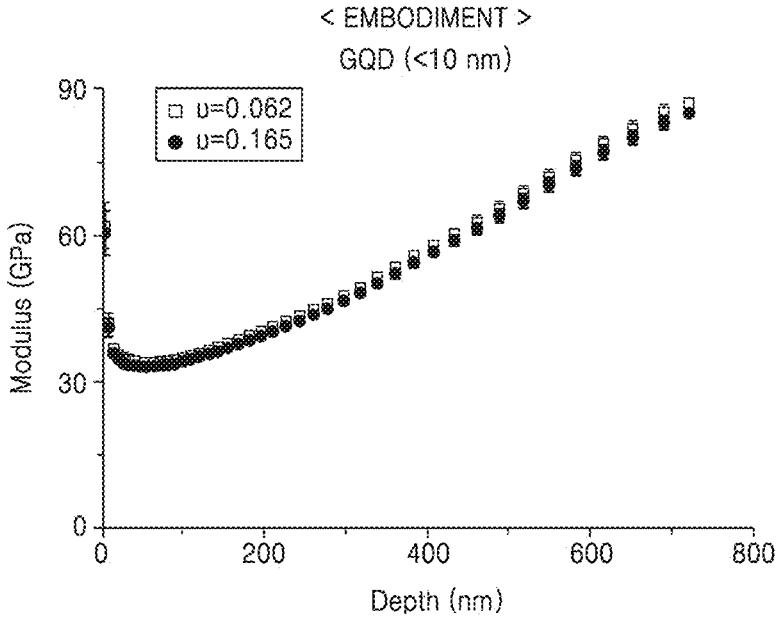
FIG. 7 shows a graph showing measurements of elastic modulus characteristics of a thin film formed according to an embodiment.

FIG. 7 shows a graph showing measurements of elastic modulus characteristics of the thin film formed according to an embodiment. FIG. 7 shows measurements of the thin film according to the embodiment of FIG. 5.

Figure 8:
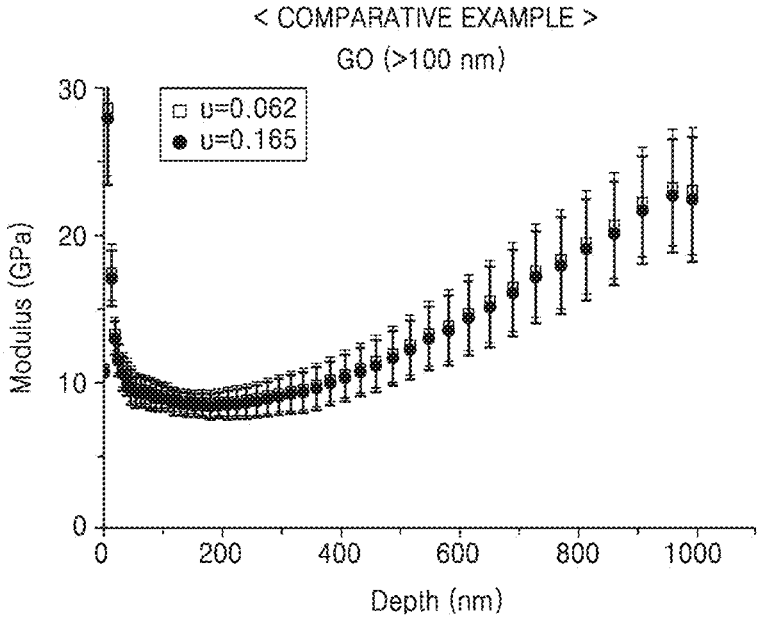
FIG. 8 shows a graph showing measurements of elastic modulus characteristics of a thin film formed according to a comparative example.

FIG. 8 shows a graph showing measurements of elastic modulus characteristics of the thin film formed according to a comparative example. FIG. 8 shows measurements of the thin film according to the comparative example of FIG. 6. In FIGS. 7 and 8, u represents a Poisson's ratio of a thin film.

Comparing FIG. 7 with FIG. 8, it can be seen that the maximum elastic modulus ($E_{max}$=72.76 GPa) and minimum elastic modulus ($E_{min}$=33.32 GPa) of the thin film according to the embodiment are relatively greater than the maximum elastic modulus ($E_{max}$=23.52 GPa) and minimum elastic modulus ($E_{min}$=8.28 GPa) of the thin film of the comparative example. As a result, it can be seen that the thin film formed according to the embodiment has a relatively excellent elastic property.

Figure 9:
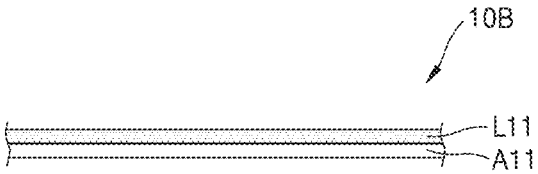
FIG. 9 shows a cross-sectional view of an acoustic diaphragm according to another embodiment.

FIG. 9 shows a cross-sectional view of an acoustic diaphragm 10B according to another embodiment.

Referring to FIG. 9, the acoustic diaphragm 10B may include an auxiliary layer A11 and a graphene-containing layer L11 provided on one side of the auxiliary layer A11. The graphene-containing layer L11 may include graphene nanoparticles. The material composition of the graphene-containing layer L11 may be the same as or similar to that of the graphene-containing layer L10 illustrated in FIG. 2. The auxiliary layer A11 may include at least one selected from cellulose, a polymer-based material, a metal-based material, and a carbon-based material. For example, the auxiliary layer A11 may include at least one selected from paper, polyester, Al, Ti, Be, carbon fiber, and CVD synthetic diamond, but the material therefor is not limited thereto. A graphene nanoparticles solution may be coated on a surface of the auxiliary layer A11 to form a thin film, and then, a heat treatment process is performed on the thin film, thereby producing the graphene-containing layer L11. By using an auxiliary layer A11 including a suitable material, the characteristics of the acoustic diaphragm 10B may be controlled. In addition, by using the auxiliary layer A11, the graphene-containing layer L11 may be formed easily.

Figure 10:
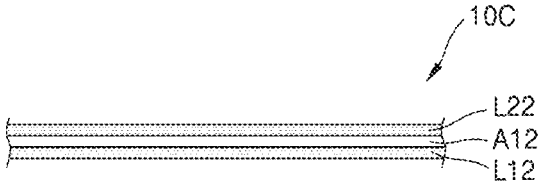
FIG. 10 shows a cross-sectional view of an acoustic diaphragm according to another embodiment.

FIG. 10 shows a cross-sectional view of an acoustic diaphragm 10C according to another embodiment.

Referring to FIG. 10, the acoustic diaphragm 10C may include an auxiliary layer A12, and may include a first graphene-containing layer L12 and a second graphene-containing layer L22 respectively formed on facing surfaces of the auxiliary layer A12. The material composition of the auxiliary layer A12 may be the same as or similar to that of the auxiliary layer A11 illustrated in FIG. 9, and the material composition of each of the first graphene-containing layer L12 and the second graphene-containing layer L22 may be the same as or similar to that of the graphene-containing layer illustrated in FIG. 9. The first graphene-containing layer L12 and the second graphene-containing layer L22 may be vertically arranged symmetrically with respect to the auxiliary layer A12. Due to the use of the auxiliary layer A12 and the first graphene-containing layer L12 and the second graphene-containing layer L22, the characteristics of the acoustic diaphragm 10C may be controlled.

Figure 11:
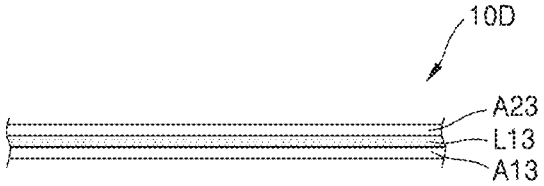
FIG. 11 shows a cross-sectional view of an acoustic diaphragm according to another embodiment.

FIG. 11 shows a cross-sectional view of an acoustic diaphragm 10D according to another embodiment.

Referring to FIG. 11, the acoustic diaphragm 10D may include first and second auxiliary layers A13 and A23 and a graphene-containing layer L13 arranged therebetween. The material composition of each of the first and second auxiliary layers A13 and A23 may be the same as or similar to the auxiliary layer A12 illustrated in FIG. 10, and the material composition of the graphene-containing layer L13 may be the same as or similar to that of the graphene-containing layer illustrated in FIG. 10. The first and second auxiliary layers A13 and A23 may be vertically arranged symmetrically with respect to the graphene-containing layer L13.

The diaphragms 10A to 10D described in FIGS. 2 and 9 to 11 may each have a thickness of about several tens micrometers (μm) or more. For example, the diaphragms 10A to 10D may each have a thickness of about 50 μm or more or about 100 μm or more. However, the appropriate thickness range may vary according to purpose.

Figure 12:
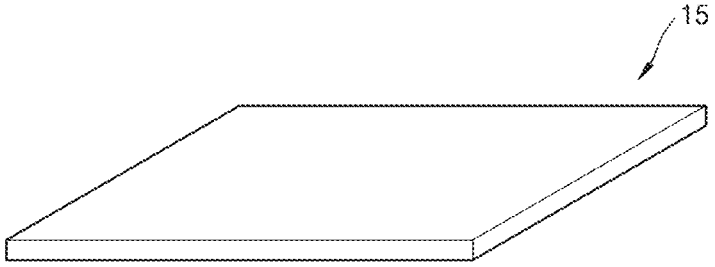
FIG. 12 shows a perspective view of an acoustic diaphragm according to another embodiment.
Figure 13:
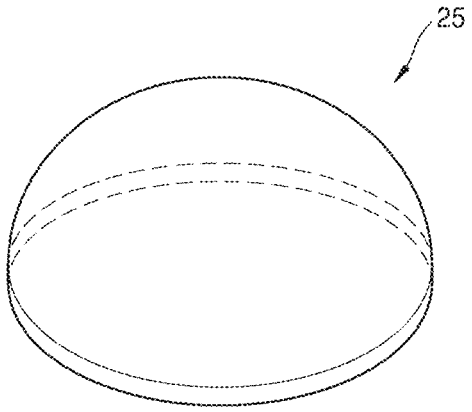
FIG. 13 shows a perspective view of an acoustic diaphragm according to another embodiment.

Although the diaphragm 10 illustrated in FIG. 1 has a cone shape, the shape of the diaphragm 10 may vary depending on the configuration of an acoustic device. For example, an acoustic diaphragm 15 illustrated in FIG. 12 may have a flat plate shape, and an acoustic diaphragm 25 illustrated in FIG. 13 may have a dome shape. The shape of an acoustic diaphragm is not limited to those illustrated herein, and may vary. Materials for the acoustic diaphragm 15 and the acoustic diaphragm 25 may be the same as anyone of diaphragms in 10A to 10D described in FIGS. 2 and 9 to 11.

Acoustic diaphragms according to embodiments of the present disclosure may be usefully applied to various acoustic devices. An acoustic device may include an acoustic diaphragm including graphene nanoparticles according to an embodiment, a support for supporting the acoustic diaphragm, and an electro-acoustic transducer or electro-acoustic converter connected to the acoustic diaphragm. In this regard, the electro-acoustic transducer may be configured to convert an electrical signal into an acoustic signal, or an acoustic signal into an electrical signal. The acoustic device may be an electromagnetic type device, an electrostatic type device, or a piezoelectric type device. For example, the acoustic device may constitute any one of a speaker, an earphone, a headphone, and a microphone, but a device that the acoustic device may constitute is not limited thereto.

The acoustic device of FIG. 1 is an electromagnetic speaker device illustrated as an example of the acoustic device. In FIG. 1, the supporting frame 8 may be an example of the support, and the magnet 1, the pole piece 3, the voice coil 6, and the like may be an example of the electro-acoustic transducer. The acoustic diaphragm 10 may be considered as an element included in the electro-acoustic transducer. Acoustic diaphragms according to embodiments may be available for an electrostatic or piezoelectric speaker device in addition to an electrostatic speaker device. Acoustic diaphragms according to embodiments may be available for an acoustic/audio device for converting an acoustic signal into an electrical signal, such as a microphone. Acoustic devices according to embodiments may be a micro device or a medium or large device. Acoustic devices according to embodiments may be available for various electronic apparatuses. The above-described electronic apparatuses may include various acoustic or image/display devices, laptop computers, tablet PCs, mobile phones, and the like, and may include small-sized or large-sized devices.

The description provided above should not be construed as limiting the scope of the present disclosure, but rather should be construed as examples of specific embodiments. For example, those skilled in the art would understand that the configurations of the acoustic diaphragms and the acoustic devices including the acoustic diaphragms described with reference to FIGS. 1 through 4 and FIGS. 9 through 13 can be variously modified. In addition, it is understood that the acoustic diaphragms according to the embodiments is not limited to the field described above, but various other fields. Therefore, the scope of the present disclosure is not to be determined by the described embodiments but should be determined by the technical ideas described in the claims.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. An acoustic diaphragm for an acoustic device, the acoustic diaphragm comprising:

a graphene-containing layer including graphene nanoparticles, wherein the graphene nanoparticles have an average particle size of 10 nm or less, the graphene-containing layer includes at least one different material other than graphene, and the at least one different material includes at least one selected from a polymer, a single molecule, a metal, and a metal complex.

2. The acoustic diaphragm of claim 1, wherein the graphene nanoparticles substantially have a particle size in the range of about 1 nm to about 10 nm.

3. The acoustic diaphragm of claim 1, wherein the graphene nanoparticles include at least one functional group selected from a hydroxyl group, a carboxyl group, a carbonyl group, an epoxy group, an amine group, and an amide group.

4. The acoustic diaphragm of claim 1, wherein the graphene nanoparticles have a carbon content in a range of about 50 at % to about 95 at %.

5. The acoustic diaphragm of claim 1, wherein an amount of the graphene nanoparticles in the graphene-containing layer is in a range of about 1 wt % to about 99 wt %.

6. The acoustic diaphragm of claim 5, wherein the amount of the graphene nanoparticles in the graphene-containing layer is in a range of about 30 wt % to about 90 wt %.

7. The acoustic diaphragm of claim 1, wherein the acoustic diaphragm further includes an auxiliary layer, wherein the graphene-containing layer is arranged on one surface or two opposite surfaces of the auxiliary layer.

8. The acoustic diaphragm of claim 7, wherein the auxiliary layer includes at least one selected from cellulose, a polymer-based material, a metal-based material, and a carbon-based material.

9. The acoustic diaphragm of claim 7, wherein the auxiliary layer includes at least one selected from paper, polyester, aluminum (Al), titanium (Ti), beryllium (Be), carbon fiber, and CVD synthetic diamond.

10. The acoustic diaphragm of claim 1, wherein the acoustic diaphragm further includes a first auxiliary layer and a second auxiliary layer, and the graphene-containing layer is arranged between the first auxiliary layer and the second auxiliary layer.

11. The acoustic diaphragm of claim 1, wherein the acoustic diaphragm has a cone shape, a flat plate shape, or a dome shape.

12. An acoustic device comprising:

an acoustic diaphragm including a graphene-containing layer including graphene nanoparticles, wherein the graphene nanoparticles substantially have a particle size in a range of about 1 nm to about 10 nm, and the graphene nanoparticles have a carbon content in a range of about 50 at % to about 95 at %, the graphene-containing layer includes at least one different material other than graphene, and the at least one different material includes at least one selected from a polymer, a single molecule, a metal, and a metal complex;

a support configured to support the acoustic diaphragm; and an electro-acoustic transducer connected to the acoustic diaphragm.

13. The acoustic diaphragm of claim 12, wherein the graphene-containing layer further includes at least one different material other than graphene, and the at least one different material includes one selected from an organic material, an inorganic material, and an organic-inorganic composite material.

14. The acoustic device of claim 12, wherein the electro-acoustic transducer is configured to convert an electrical signal into an acoustic signal.

15. The acoustic device of claim 12, wherein the electro-acoustic transducer is configured to convert an acoustic signal into an electrical signal.

16. The acoustic device of claim 12, wherein the acoustic device is an electromagnetic-type device, an electrostatic-type device, or a piezoelectric-type device.

17. The acoustic device of claim 12, wherein the acoustic device is any one of a speaker, an earphone, a headphone, and a microphone.

18. An electronic apparatus comprising:

the acoustic device according to claim 12.

19. An acoustic device comprising:

an acoustic diaphragm including a graphene-containing layer including graphene quantum dots (GQDs), wherein the graphene-containing layer includes at least one different material other than graphene, and the at least one different material includes at least one selected from a polymer, a single molecule, a metal, and a metal complex;

a support configured to support the acoustic diaphragm; and an electro-acoustic transducer connected to the acoustic diaphragm.

* * * * *